US005685707A

United States Patent [19]

Ramsdell et al.

[11] Patent Number: 5,685,707

[45] Date of Patent: Nov. 11, 1997

[54] INTEGRATED BURNER ASSEMBLY

[75] Inventors: John L. Ramsdell, Hudson; Steven G. Hrabak, North Royalton, both of Ohio

[73] Assignee: North American Manufacturing Company, Cleveland, Ohio

[21] Appl. No.: 585,623

[22] Filed: Jan. 16, 1996

[51] Int. Cl.[6] ..... F23N 5/00

[52] U.S. Cl. ..... 431/90; 431/31; 431/62; 431/63

[58] Field of Search ..... 431/31, 63, 62, 431/90

[56] References Cited

U.S. PATENT DOCUMENTS

| | | | |
|---|---|---|---|
| 3,236,449 | 2/1966 | Brunner | 431/90 |
| 3,694,137 | 9/1972 | Fichter et al. . | |
| 4,043,742 | 8/1977 | Egan et al. | 431/90 |
| 4,118,172 | 10/1978 | Noir et al. . | |
| 4,329,138 | 5/1982 | Riordan | 431/90 |
| 4,498,863 | 2/1985 | Hanson et al. | 431/90 |
| 4,533,315 | 8/1985 | Nelson . | |
| 4,645,450 | 2/1987 | West . | |
| 4,746,284 | 5/1988 | Geary | 431/67 |
| 4,872,828 | 10/1989 | Mierzwinski et al. . | |
| 4,927,351 | 5/1990 | Hagar et al. | 431/90 |
| 4,955,806 | 9/1990 | Grunden et al. . | |
| 5,088,916 | 2/1992 | Furuhashi et al. | 431/90 |
| 5,513,979 | 5/1996 | Pallek et al. | 431/90 |
| 5,520,533 | 5/1996 | Vroliik | 431/90 |

*Primary Examiner*—Carroll B. Dority
*Attorney, Agent, or Firm*—Jones, Day, Reavis & Pogue

[57] ABSTRACT

An integrated burner system is disclosed having a fuel supply assembly including a fuel control for variably limiting the flow of fuel into the burner along with a discrete air control for generating a variable flow of air into the burner. The respective fuel and air controls are directed by a control system which operates these controls in order to provide and maintain a desired fuel-to-air ratio between high fire and low fire in response to a requirement for heat. A multiple burner embodiment is disclosed in which a plurality of the present integrated burners may be used to create a multiple burner system which provides a greater degree of control and efficiency than that capable with previous systems. The multiple burner embodiment also eliminates the costly installation and maintenance requirements typically associated with previous systems.

14 Claims, 6 Drawing Sheets

INTEGRATED BURNER ASSEMBLY

BACKGROUND OF THE INVENTION

The present invention is directed to the field of burner systems where fuel and air are combusted. Such burner systems are particularly used in industrial processes where high temperatures are required, e.g. the manufacture and processing of metal, certain chemical processes and the like.

In previous systems, air is typically supplied to the burner by a blower which operates at a constant RPM, supplying a flow of air at a relatively constant pressure. The flow of air is controlled by an air valve which reduces the air flow to a level below that of the blower output by increasing resistance to the air flow. Similarly, a fuel valve is used to vary fuel flow at levels below that of a constant supply maximum.

During the initial stages of a thermal process, the burner is commonly operated at high fire, i.e. a high rate of heat input through combustion. At high fire, fuel and air are combusted at respectively high flows while maintaining an air-to-fuel ratio slightly above stoichiometric, i.e. the level of maximum heat release. At stoichiometric combustion, the air is supplied at a level sufficient to provide just enough oxygen to fully combust or oxidize the available fuel. As a practical consideration, "stoichiometric" combustion is typically operated at about 10% excess air above true stoichiometric in order to compensate for common fluctuations in the calorific value of the fuel and the ambient temperature changes in the combustion air.

At high fire, a large heat input is applied to the furnace and its load in order to quickly and efficiently raise the load temperature. At a later stage in the process, as the load begins to approach the set point temperature, the heat input must be lowered so that the furnace and its load are not damaged through overheating. At this later stage, the burner operation is reduced to low fire, i.e. lowering the rate of combustion. The ratio of the maximum to the minimum heat input rates is referred to as the turndown ability of the system. Modern furnace construction provides for minimal heat loss at operating temperatures, and so high turndown rates are required for the combustion systems, i.e., 10 to 1 and greater.

Two ways of achieving turndown are commonly used, thermal and stoichiometric. During "thermal" or "excess air" turndown, the flow of fuel is reduced while the air flow is held constant, effectively lowering the fuel-to-air ratio. In this way, a high excess air condition prevails. Since the excess air is heated by the combustion, the released heat is "diluted," and the temperature of the gases issuing from the burner is reduced. Thermal turndown is not fuel efficient because the excess air effectively becomes part of the furnace load. Thermal turndown is generally used when trying to maximize the heat transfer being done by convection. Turndown with this type of control can be very high.

The other method of achieving turndown is to perform "stoichiometric" or "on-ratio" turndown in which gas and air are reduced by proportional amounts. Stoichiometric turndown is more fuel efficient since air is supplied at a rate close to the stoichiometric ratio for optimal combustion with the fuel, thus permitting maximum heat release (and thus work) per unit fuel. Stoichiometric turndown is theoretically more efficient, but achieving large "on-ratio" turndowns is difficult to obtain due to the mechanical limitations of the controlling and proportioning equipment and the stability limits of the burners.

There are basically three types of control which respond to temperature demand: on-off, two position, and proportioning control. These methods are directed by four basic types of fuel/air ratio control: fixed orifices, valve control, pressure control and flow control.

Fuel/air ratio control with fixed orifices requires a constant pressure upstream of the orifices to achieve the desired proportioned flow rates of the fuel and air. This type of control is for a single firing rate used with on-off control. On-off control gives the greatest possible turndown ratio but presents problems in temperature uniformity at set point. Such a system design must also be very complex in order to meet safety requirements.

Valve control of fuel/air ratio is achieved by use of constant pressures and variable areas. A simple mechanism can be used to cause the opening of the two valves to vary in proportion to one another. This requires that the valves have identical flow characteristics and the mechanical connection between them produces directly proportional movement. These two features are very difficult to achieve causing the fuel/air ratio to match at only two points (high and low) throughout the range and be either lean or rich at firing rates between them. Generally this type of ratioing is used with mechanically linked valves and with two-position control in response to a temperature demand. Mechanically linked valves vary the fuel and air simultaneously.

Pressure control of fuel-air ratio is based on the principle that the resistance to flow downstream of the control valves is a constant in both the fuel and air lines of a burner system. Therefore, if the pressures are kept equal or proportional, then the fuel and air flow rates will be proportional, throughout the whole range of firing rates. Unlike the previously discussed systems which work on constant pressures and variable areas, a pressure control system works with constant areas and variable pressures. It is common with this type of system to assign the air as the primary control allowing the fuel to follow its lead. The components in the air line necessary to allow the fuel to be the primary controlling medium are large, expensive and in many cases not available. Although this method can be used with two position control it is more normally used with fully proportional temperature control.

A very common type of pressure control method is the pressure balance regulator system. The fuel flow varies as the pneumatic impulse to the regulator is changed. This change is in response to movement of the input controlling air valve. The controlling air valve is always located on the outlet of the blower in multi-zone furnaces and usually in single zone units, causing a waste of electrical energy. The same waste occurs with air valves on the inlet to blowers but not to the same degree.

The fuel-air ratio controller of flow control systems actually measures the air flow and the fuel flow and controls one the fluids accordingly. The measurement of the flow rates requires that a constriction such as an orifice or a Venturi be placed in both the air and fuel lines. The pressure differentials are transmitted to some controlling device that adjusts the flow of either the fuel or the air to maintain the desired fuel air ratio. This method is normally used in larger combustion systems where turndown is important yet the pressure needs must be kept low to minimize the horsepower requirements of the combustion air blower.

Flow control systems use proportional fuel/air ratio control. To maximize the turndown capabilities of the components fuel is used as the primary controlling medium. This is accomplished by having the air follow the fuel down in an on-ratio mode to some stable repeatable point, then locking it and continuing down with the fuel in an excess-air or thermal turndown mode. This method gives the combination of high turndown and good fuel efficiency.

The disadvantages to this type of system is the cost of installation. Typical flow control systems are very piping dependent requiring ample sizing to minimize piping pressure drop at high flow rates, symmetrical piping to insure even distribution at low rates and long runs for the orifice or Venturi assemblies to insure as the flow changes quiet repeatable signals are sent to the ratio controlling device.

The most desirable type of control system is a flow metered control system 10 as shown in FIG. 1A, which shows a single burner system. However, this type of control can also be used with multiple burner systems. In this type of system, fuel is provided to the burner 12 by a utility fuel supply 14 while air is supplied by a blower 16. Within each respective supply line, there are respective fuel and air orifice plates 18, 20 which each establish a pressure drop whereby the respective flows of fuel and air can be matched by comparing pressure differentials according to known pressure relationships. Pressure transducers 22, 24 are used to generate signals representative of the respective fuel and air differential pressures. These signals are compared by a control unit 26 which generates a signal which varies the position of a control valve 28. This control valve 28 can control either the air or fuel flow in response to a variation in the respective other flow. In this way, a mass flow system can be either a "fuel primary" or "air primary" system. Mass flow systems typically offer better ratio control and more economical turndown as compared with other control systems.

In spite of its improved performance, the flow control systems still suffer from the same problems as the other types of systems, especially wasted electrical energy. The actual horsepower requirement of any blower is a product of the volume times the pressure developed divided by a constant and by the theoretical horsepower requirement. It is important to understand that in any system with fixed downstream orifices, flow is proportional to the square root of the pressure drop. Therefore, reducing the flow to a burner system without reducing the pressure when it is no longer needed wastes purchased electrical energy. The thermal power applied to the load is a function of the respective supply pressures. Fuel pressure is supplied by the utility, but air pressure is generated by the customer's blower 16. Therefore, it is in the customer's best interest to maximize blower efficiency in order to receive the best return on the operating expenses of the blower. However, a significant pressure loss occurs across the air orifice plate 20, thus diminishing the blower's contribution to the thermal power of the burner. Other pressure losses occur across the valving, along each length of piping in the delivery system, requiring extra horsepower to overcome these losses.

In the majority of industrial heating applications, temperature uniformity of the load during the heat up and soaking process is crucial to the quality of the product. To achieve this uniformity in both batch or continuous furnaces, multiple burners systems are used to promote a more even temperature distribution. To further enhance this preferable condition, "zoning" is often added to the burner configuration. A number of burners are used to effectively divide the furnace into smaller units or "zones" which are better able to overcome uneven heat losses and/or load configurations within the furnace. Zoning of conventional systems does require the addition of more components and hard piping for both the fuel and the air supply. Zoning also dictates that it is desirable that the pressure upstream of each zone control valve remain constant and at its maximum level while the furnace is operating. The constant upstream pressure eliminates "hunting" of the other zone control values when one changes its position due to a command from the temperature controller.

The most common multiple burner system uses the cross connect regulator method of fuel air ratio control and is shown in FIG. 1B. A common air supply 44 and conditioned fuel supply 42 is divided between a plurality of burners. In the air line common to all burners within a single zone of control is a temperature driven control valve 50 and in the individual air line to each burner a shutoff butterfly valve 46. In single burner systems this valve is normally omitted.

In the fuel line common to all the burners is a pressure balanced cross connected regulator 52 impulsed by the main combustion air. Variations to this include a separate regulator for each side and each level of burners within a zone. The individual gas lines to each burner 40 contain a shutoff gas cock 56, a limiting orifice valve 60 for setting the gas flow and an optional metering orifice 58 for measuring the flow.

In addition, it is normal to have a pilot system 62 acting as source of initial ignition for the main burners. Such a pilot system is effectively a second and much smaller combustion system, equal in number of burners to the main system, and which requires its own set of fuel and air components installed in its own separate air and gas headers. Spark plugs, ignition transformers and cables are often used with these pilot systems especially if flame monitoring is used.

The above-indicated combustion systems have many shortcomings. Turndown is somewhat limited without added horsepower for higher blower pressure. Turndown is also limited because of the mechanical limitations of the ratio controlling components. Such previous systems also have a high installation cost due to piping requirements. Further, a large number of such components require individual installation. Thus, such previous systems tend to be expensive and time-consuming to install and are limited in their turndown ability.

SUMMARY OF THE INVENTION

In view of the above-noted disadvantages encountered in prior systems, there is therefore a need for a burner system that minimizes the shortcomings of the typical systems.

There is also a need for a system which improves fuel efficiency without sacrificing system turndown by incorporating on ratio and excess firing as the fuel needs to the system decrease.

There is also a need for a burner system which reduces electrical energy consumption due to the reduction of piping and control component drops.

There is also a need for a burner system which reduces electrical energy consumption by incorporating a variable speed blower assembly which reduces the horsepower needs proportionally as fuel flow is decreased.

There is also need for a burner system which reduces the number of required components by eliminating them or by incorporating them within the burner assembly.

There is also a need for a burner system which eliminates the main and pilot combustion air piping and also the pilot gas piping.

There is also a need for a multiple burner system which allows greater zoning control.

There is also a need for a burner system which incorporates a simpler and less time-consuming method of burner set up and adjustment.

There is also a need for an integrated burner system in which the air and fuel supply elements are provided in an y to install integrated package.

There is also a need for a burner system in which air flow is varied in response to the fuel demands of the burner, thus permitting more precise burner control and increasing overall burner efficiency.

There is also a need for a multiple burner system which requires a minimum of calibration upon installation, thus lowering installation costs.

The above and other needs are satisfied by the present invention in which an integrated burner system is shown having a fuel supply assembly including a fuel control for variably limiting the flow of fuel through a fuel passage into the burner along with a responsive air control for generating a variable rate of air flow into the burner. The air control is directed by a control system which operates in a manner to provide and maintain a desired fuel-to-air ratio. The control system includes a control unit for varying the flow of fuel and thus air between high fire and low fire in response to a requirement for heat, thereby producing a desired rate of combustion.

The control system of the present invention operates in response to the temperature demands of the system. Fuel flow is measured using a fuel sensor which measures a pressure differential across a metering orifice and generates a signal representative of the fuel pressure differential. Similarly, air flow is measured using an air sensor which measures the pressure differential between the burner chamber and atmospheric and generates a signal representative of the air pressure differential. The control unit compares the respective pressure differential signals in order to produce an air flow rate which maintain the desired fuel to air ratio in response to the heat demands of the system.

The above and other features of the invention will become apparent from consideration of the following detailed description of the invention which presents a preferred embodiment of the invention as is particularly illustrated in the accompanying drawings.

DETAILED DESCRIPTION OF THE PREFERRED EMBODIMENT

The present integrated burner solves the problems of such previous systems by providing an integrated burner assembly which integrates a burner and a mass flow control system into one package. The burner section is integral with a fuel/air ratio control system which, in the preferred embodiment, incorporates variable speed delivery of the air. During operation, the integrated burner operates more efficiently and consumes less power since the rate of air flow is electronically varied in response to the rate of fuel flow and the heat requirements of the burner in order to maintain a desired fuel/air ratio.

Figure 1A:
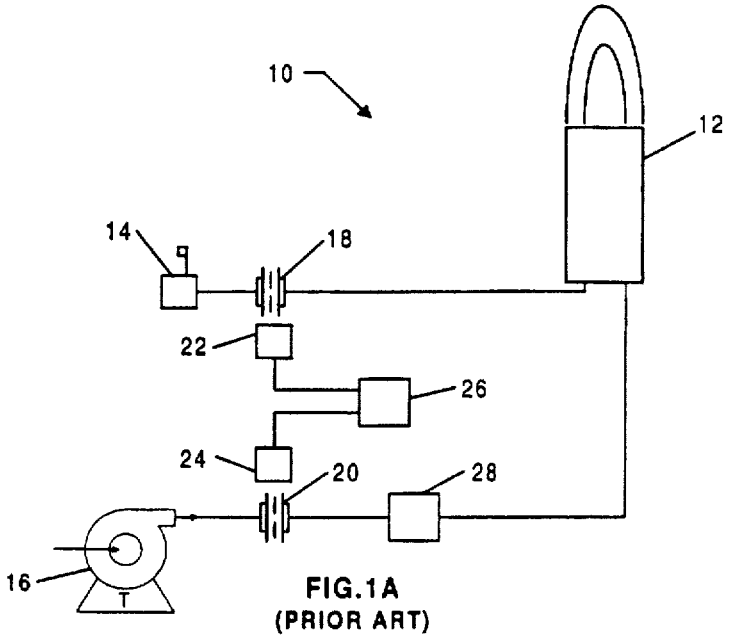
FIG.1A (PRIOR ART)
FIG. 1A represents a single burner flow control type system.
Figure 1B:
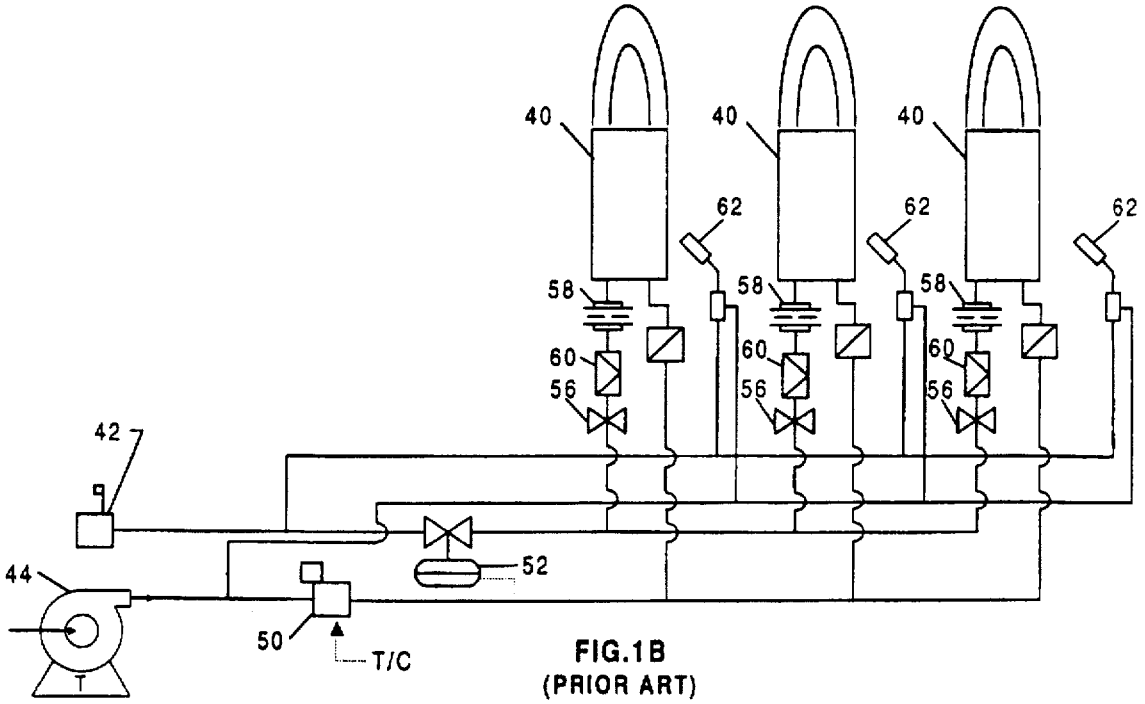
FIG.1B (PRIOR ART)
FIG. 1B represents a multi-burner pressure control system, as are typically used with previous burner systems.
Figure 2:
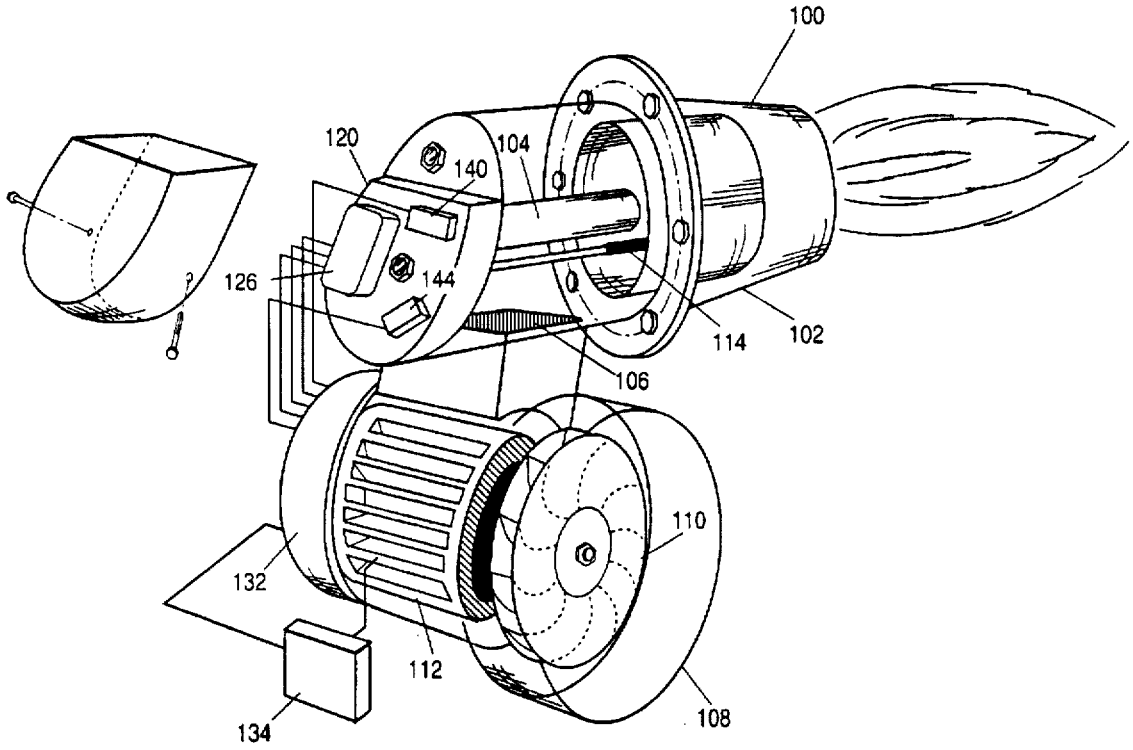
FIG. 2 is an oblique view representing the general configuration of the integrated burner system as according to the present invention.

Referring now to FIG. 2, the integrated burner assembly 100 includes a burner tile 102, a fuel tube 104 and an air inlet 106. Air is supplied to the burner 110. Air is supplied to the burner from an integral high speed blower assembly 108. This assembly includes a silencer inlet cover, a housing, a small diameter backward curved impeller 110 and a 60 hertz, totally enclosed, air-over electric motor 112. The speed of rotation of the motor 112 and in turn the impeller 110 is controlled by a variable speed drive 134 running at the direction of the ratio controller. The impeller tip speed (related to impeller diameter) governs the pressure developed by a blower and the width at that speed determines the volume generated. Therefore, the higher the speed of the impeller 110, the smaller the diameter will be for a given pressure.

Turning a burner up or down is accomplished by increasing or decreasing the flow rates of its fuel and air. Flow is directly related to the square root of the pressure change or drop across its controlling orifices. Therefore, the higher the available pressure the more the available turndown. Varying flow and pressure by varying the rotational velocity of the impeller also saves electrical energy. Blower horsepower requirements (and thus electrical energy) vary as the cube of the impeller rpm. In addition, the use of a high speed radial blower with axial flow discharge allows the use of a motor without its own cooling source and provides for a light weight compact unit necessary for an integrated burner assembly. The impeller is a high-speed impeller 110 capable of an 9000 rpm rate of rotation. Due to its high rate of rotation, the impeller 110 can be small in diameter and yet still develop the desired pressure and move a quantity of air. This permits the impeller to be sufficiently small so that it can be incorporated into the integrated package.

The impeller 110 is driven by an electric A.C. motor 112. The motor 112 is preferably an AC motor capable of producing the high rate of impeller rotation. The rate of air flow is varied by varying the power to the impeller motor 112, in response to signals from the control unit 132. Thus, the power consumed by the impeller 110 is only that necessary to directly supply the air to the burner. In this way, inefficient power consumption due to pressure losses and unwanted air volumes is decreased.

Figure 3A:
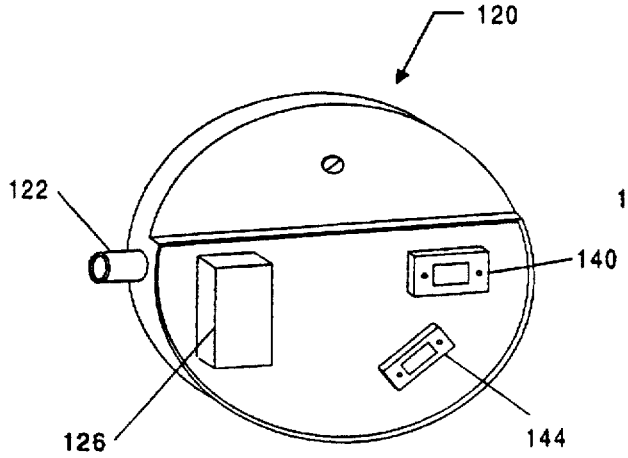
FIGS. 3A and 3B show assembled and cutaway views of the backplate assembly as according to the present invention.
Figure 3B:
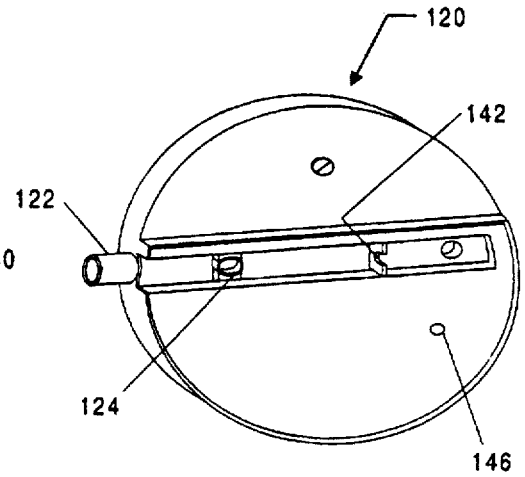

The fuel is supplied to the burner through the backplate assembly 120, shown particularly in FIGS. 3A and 3B, which is integral with and attached to the back of the burner 100. The backplate assembly 120 includes a fuel access passage 122 which is a cavity formed within the backplate assembly 120. The fuel flow in the passage 122 is regulated by a ball valve 124, which is controlled by a control motor 126. The control unit 126 is a direct coupled 90° actuator mounted directly on the shaft of the internal ball valve. The actuator has integral potentiometers and comparator circuits as well as auxiliary switches and is driven by a 4 to 20 mA signal. The auxiliary switches are used to prove the fuel controlling ball valve is fully closed prior to ignition of the burner. The actuator at the direction of the customer supplied temperature controller rotates the ball 124 about an axis perpendicular to the fuel passage and the backplate.

The present invention incorporates an electronic fuel/air ratio control system 132 which regulates the flow of air in the correct proportion to the fuel in order to control the combustion in the desired manner. It does this in response to signals it receives from sensors included in the burner assembly. During start-up the burner is ignited at "low fire," a high excess air condition which produces a low level of heat but is ample enough to provide a permissive signal to the flame monitoring system through a included flame detecting device 114, preferably a flame rod. However, an ultraviolet sensor may also be used. The ignition is accomplished by allowing a small but adjustable amount of fuel to by-pass the controlling ball valve 124 and pass over a "hot surface igniter" (HSI) located in the air-filled fuel tube. The HSI was energized only after all the conditions for a safe start ignition sequence had been satisfied.

Figure 5:
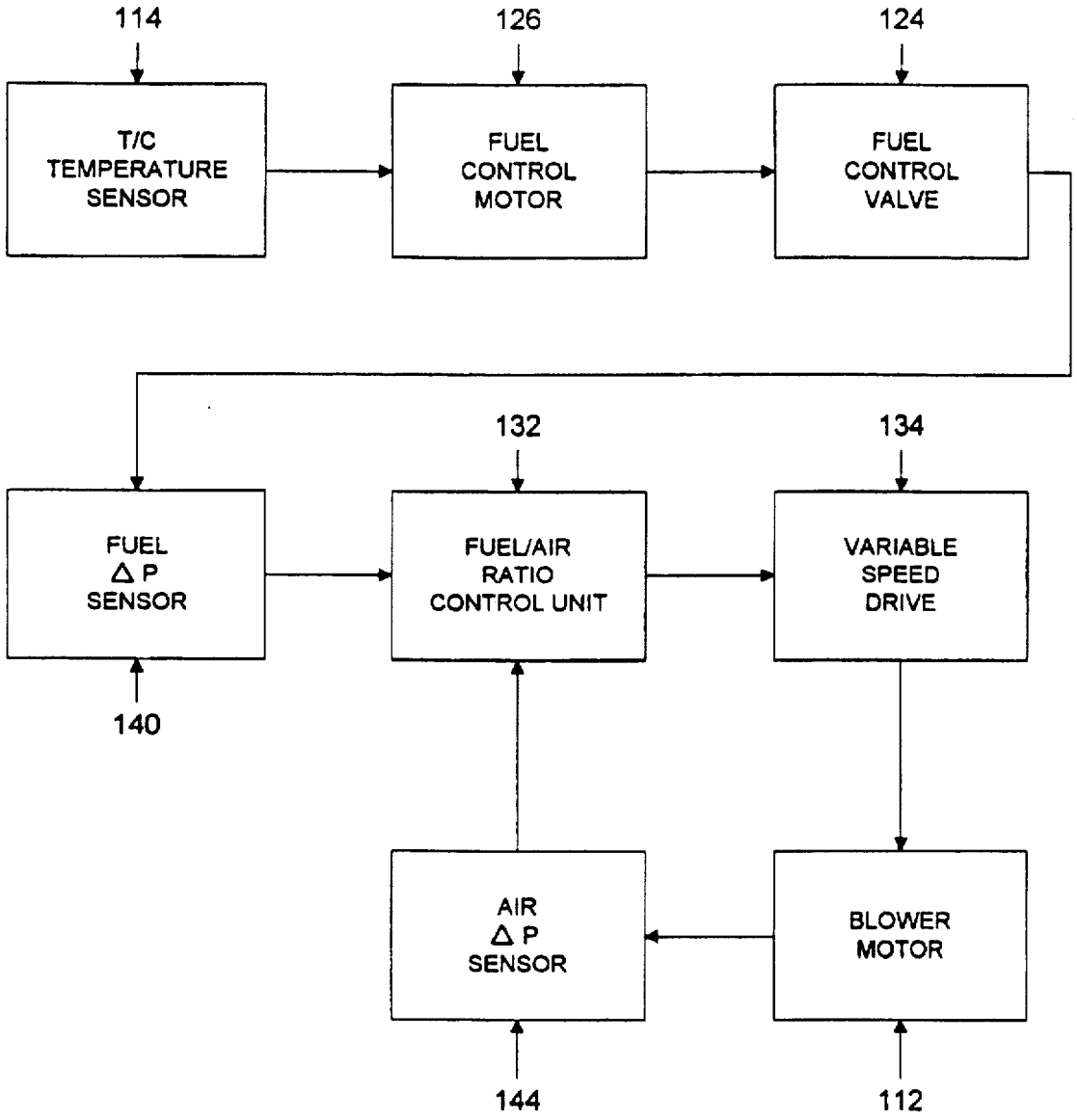
FIG. 5 is a flow chart giving the general operation of the control system as according to the present invention.
Figure 7:
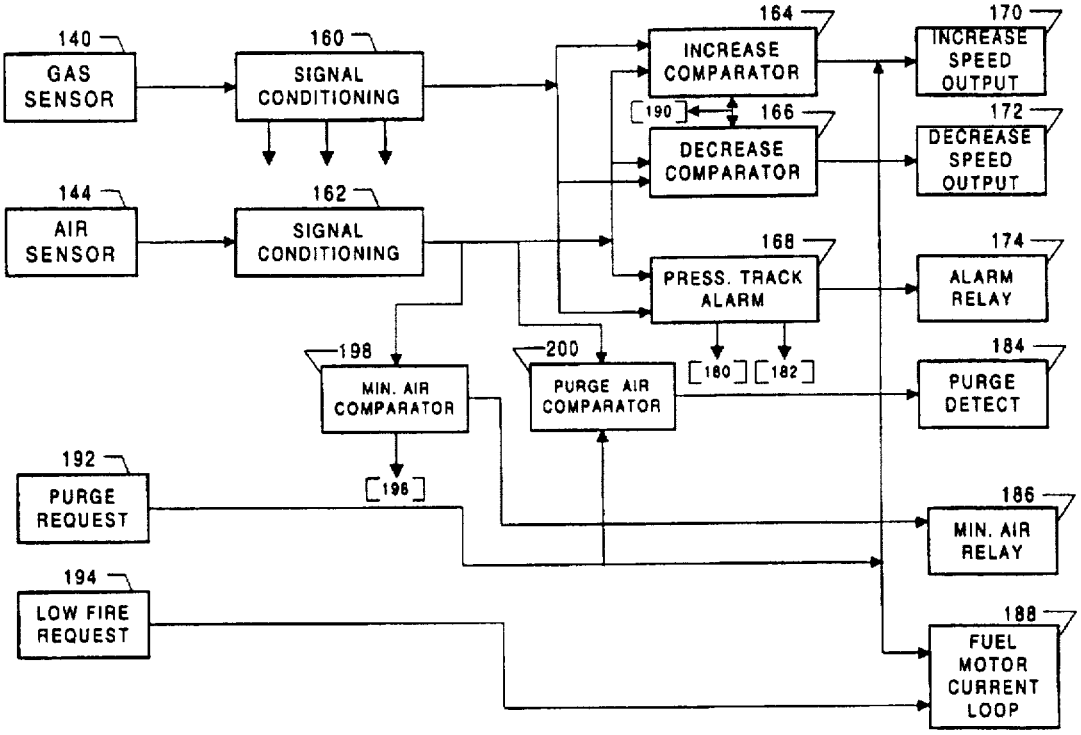
FIG. 7 is a block diagram showing the operation of the ratio controller of the present control system.

The operation of the control system 132 is shown generally by the flow chart of FIG. 5. The heat released by the flame is measured with a temperature sensor (not shown) which is a component of the customer's furnace. The valve control unit 126 receives the temperature signal which indicates a need for more heat from the burner. In response, the valve control motor rotates the ball valve 124 thereby admitting more fuel into the burner. In the preferred embodiment the ratio control unit senses the change and functions as described below. The control system is defined by a variable speed drive ratio controller 132 as shown in the block diagram of FIG. 7. Differential pressure transducers 140, 144 are used to respectively measure gas and air differential. The air transducer 144 uses the burner itself as the air flow orifice. The differential pressure being compared is that of burner body pressure to outside atmospheric pressures or that of the combustion chamber itself. While the chamber can be at atmospheric, it can also be maintained at any other desired pressure. The gas differential pressure transducer 140 is across a machined concentric orifice plate located upstream of the flow controlling ball valve 124 within the backplate assembly 120.

The signals from each transducers are first subject to signal conditioning 160, 162. The gas differential pressure transducer signal can be trimmed to correct for offsets and gain differences between the transducers as well as minor machining differences in the air and gas orifices between one burner and another. After scaling, the differential pressure signals are compared to each other in either the increase or decrease comparator circuits 164, 166. If the air differential pressure is lower than the scaled gas differential pressure by an amount greater than that specified by the dead band adjustment 190, the increase comparator 164 issues a pulse to the increase speed output circuit 170. Likewise, if the air differential pressure is greater than the scaled gas differential pressure by an amount greater than that specified by the dead band adjustment then the decrease comparator 166 issues a pulse to the decrease speed output circuit 172. In both cases the width of the pulse is dependent on the magnitude of error so that for small errors, only small changes in the speed of the blower are requested. Pulses are issued at a rate of about 100 Hz until the error is within the dead band 190.

The ratio controller 132 monitors its own performance via a window comparator circuit. The pressure tracking alarm circuit 168 monitors the air differential pressure signal and the scaled gas differential pressure signal. If the difference between the two signals is larger than an amount set by the tracking error alarm window 180 adjustment then a timer is started. If the timer is allowed to run for a time longer than a time set by the alarm delay 182 adjustment then the coil of the alarm relay is depowered and the alarm contacts close, lighting an alarm LED. If the two pressure signals come back within the alarm window 180 the alarm and timer are both reset.

The ratio controller 132 also abets the implementation of flame supervision by including purge and low fire request circuits 192, 194 which accept start signals from flame supervisory equipment. During a purge request, the purge request circuit 192 disables the increase and decrease comparators 164, 166 as well as the pressure tracking alarm 168 and the increase speed output 170 is forced on. In addition, the fuel motor current loop relay 188 is depowered, forcing the fuel valve to its closed or low fire position. Proof of this is sent to the flame supervisory system by the auxiliary contact on the primary control motor. During a purge request, when a purge air flow comparator 200 measures the air differential pressure as exceeding a factory set threshold, the purge detect relay 184 is energized closing a contact and lighting a purge LED. The low fire request circuit 194 simply depowers the fuel motor current loop relay 188 causing the normal ratio control sequence to bring the blower speed down to the low fire setting.

In addition, whenever the air differential pressure is measured by the minimum air flow comparator 198 to be above that set by the minimum air flow threshold adjustment 196, the ratio controller 132 energizes the minimum air flow relay 186 closing a contact and lighting a flow detect LED. This contact is meant to be included in the permanent limit circuit that allows the system to operate.

Included in the backplate assembly 120 and located upstream of the ball valve 124 in the fuel passage 122 is an orifice plate 142 with a calculated bore. The bore size determines the fuel flow at given pressure differential when the upstream pressure, temperature and calorific value of the fuel are known. The fuel differential pressure transducer 140 with pressure sensing taps located on either side of the orifice 142 senses the changes in pressure drop across the orifice 142 as the fuel flow is either increased or decreased sending this information to the previously described ratio controller 132.

Also located on the backplate assembly is the air differential pressure transducer 144 which includes pressure sensing taps located across the burner body and atmospheric or chamber pressure. As stated above this transducer 144 closes the feedback loop to the ratio controller 132, indicating the corrective action taken by the variable speed drive 134 under the direction of the ratio controller 132. The variable speed drive 134 is responsible for the rotational speed of the motor and the impeller which is mounted directly on the shaft of the motor.

Figure 4:
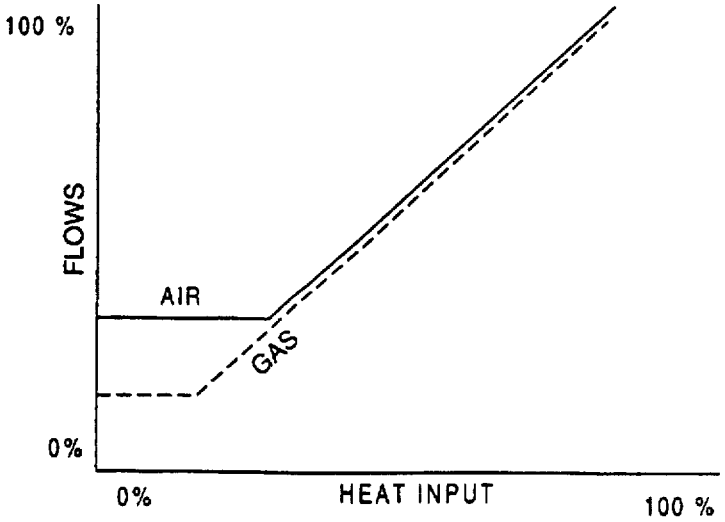
FIG. 4 is a graph depicting the relationship between air pressure and fuel pressure as the burner is increased from low fire to high fire.

As has been inferred in early paragraphs, the rotational speed of the impeller 110 is proportional to the volume of air produced, i.e. the faster the speed, the greater the volume produced. As can be seen from FIG. 4, as more heat is required, the fuel increases from its minimum ignition setting to its maximum flow rating. The air, which has been set at is minimum flow rating conducive with good burner light off, stability and excess air rate, does not change until the fuel reaches a point where the ratio between them is close to stoichiometric, at which time they continue together maintaining this fuel efficient condition. The precise air flow necessary to produce this condition is done by regulating the rotational speed of the impeller 110. This is done at the direction of the variable speed drive 134 which is responding to the input of the ratio controller 132.

On initial bring up, the burner operates at "high fire" only long enough to satisfy the requirements of the temperature controller after which it begins to throttle back or turn down to a lower firing rate, holding the set point and allowing the load to soak out to a uniform temperature. Since within any given batch or continuous furnace the load configurations, sizes and control temperatures can vary the turndown ability of the burner(s) must operate in such a way that, without turning them off, they must supply only enough heat to maintain the control set point without overheating the load. The present invention accomplishes this while maintaining a high degree of fuel efficiency. The present invention allows the input to be reduced to 20–25% of its maximum design rate before going into the excess air or thermal turndown mode.

The present integrated burner requires less time and expertise to install. With the present system, the blower, control valves and piping are eliminated, and so the pressure losses associated with these components are also eliminated. Since the air supply is controlled directly in response to the needs of the burner, air supply power consumption is matched to the burner demand, and so the integrated burner is more efficient and thus less expensive to operate.

Figure 6:
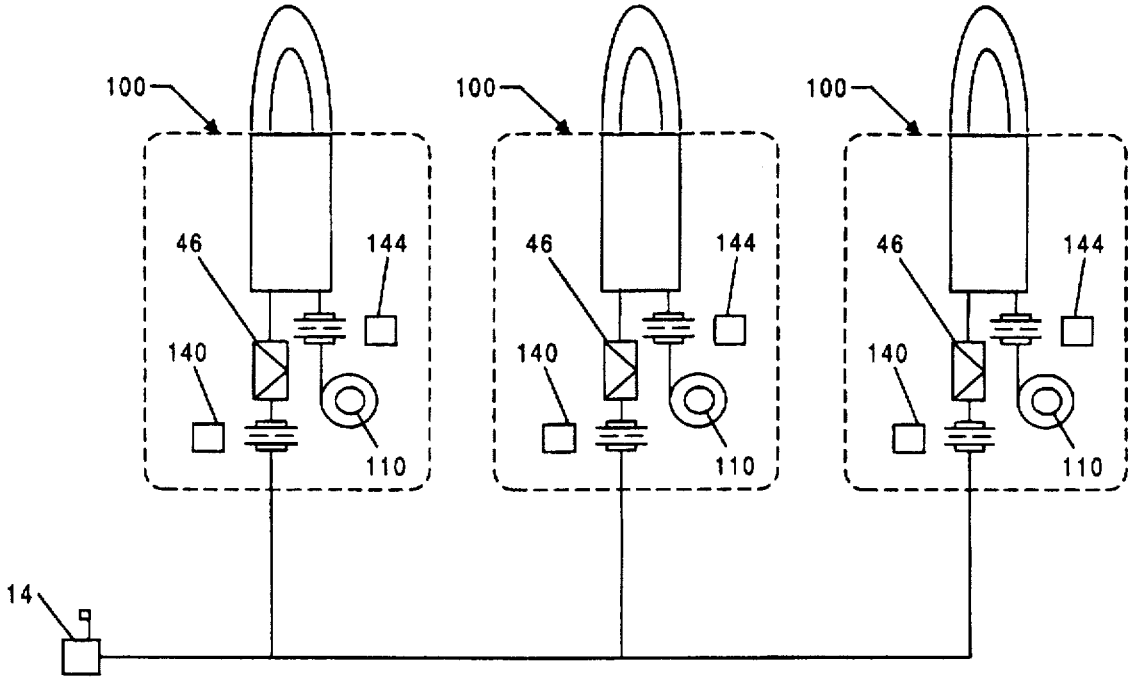
FIG. 6 is a schematic view showing a multiple burner package embodiment in accordance with the present invention.

The present integrated burner can also be used in a multiple burner system which greatly simplifies the installation of the system. As shown in FIG. 6, each burner is itself an integrated package, the only external supply system, other than electrical, being the utility fuel service. This is accomplished by removing the fuel input control motor 126 from each shaft of the ball valve 124 and substituting a locking nut, allowing the open valve 124 to define the maximum fuel flow rate of the individual burner. The burners are connected to a common fuel supply manifold in which the flow is regulated by the demand of the temperature controller. Each burner operates as described above. The fuel flow change is measured by the fuel transducer 140, and the ratio device, sensing the change in flow, directs the variable speed controller 134 to change the RPM of the impeller 110 accordingly. The air flow transducer 144 detects the requested change, thus assuring the ratio controller 132 that the flows of the fuel and air are within prescribed and predetermined limits of one another.

The integrated burner installed in a multiple burner application allows for hitherto unknown flexibility in furnace zoning and temperature profiling within zones. Since each integrated burner in a single or multiple burner installation has its own controlled air supply regulated precisely in accordance with the fuel flow, the pressure losses accompanying the use of orifice plates, control valves and piping have been eliminated. The result is lower initial installed electrical energy requirements and lower actual energy running costs. Still further, in the event of the clogging of a fuel line to a burner 100, the remaining burners would not be thrown off-ratio since the air flow control elements of each burner 100 would compensate by adjusting the respective air flows to match that of the fuel flow, while discontinuing the air flow to the clogged burner. In this way, the furnace can operate without the compromise in performance which would have resulted from a comparable failure in a previous system.

In its multiple burner embodiment, the present invention offers a burner control which eliminates installation calibration expense and operating costs due to air pressure losses.

The foregoing description of the preferred embodiment has been presented for purposes of illustration and description. It is not intended to be limiting insofar as to exclude other modifications and variations such as would occur to those skilled in the art. Any modifications such as would occur to those skilled in the art in view of the above teachings are contemplated as being within the scope of the invention as defined by the appended claims.

We claim:

1. An integrated burner system for combusting two reactants comprising:

a burner for receiving a first reactant and a second reactant in order to effect combustion;

a flow control formed integrally with the burner for variably limiting and controlling the rate of flow of the first reactant into the burner in response to the demands of the system;

a blower assembly formed integrally with the burner for generating a variable rate of pressure and flow of the second reactant into the burner;

a flow control system for measuring reactant flows and directing the operation of the blower assembly so that the variable rate of flow of the second reactant is generated in response to the rate of flow of the first reactant so as to maintain a desired fuel-to-air ratio.

2. The burner system of claim 1 wherein the control system further comprises a first reactant pressure differential transducer and a second reactant pressure differential transducer for respectively measuring the flows of the first and second reactants, wherein the control system directs the blower assembly to produce a variable rate of flow in response to signals received from the respective transducers.

3. The multiple burner system of claim 2 wherein the first reactant is fuel and the second reactant is air and wherein:

the first reactant transducer measures a pressure differential across a metering device and generates a first signal representative of the fuel flow into the burner, said first signal is received by said control system;

a second reactant transducer which measures the air pressure differential between the burner and atmospheric and generates a second signal representative of the air flow through the burner, said second signal is received by said control system;

and wherein the control system compares the respective first and second signals in order to vary the produced air flow rate in response to the fuel flow rate so as to establish a predetermined fuel-to-air ratio.

4. The burner system of claim 1 wherein the flow control includes a control motor which opens and closes a valve in response to signals received from the control system and wherein the blower assembly includes an impeller attached to a motor driven by a variable speed drive which rotates the impeller to produce the variable rate of second reactant flow in response to signals received from the control system.

5. The burner assembly of claim 1 wherein the burner is a single burner system.

6. The burner assembly of claim 1 wherein the burner is one of a plurality of such burners which are used in a multiple burner system.

7. The burner system of claim 1 wherein said first reactant is gas fuel and the second reactant is air.

8. A multiple burner system for combusting two reactants, said burner system comprising:

a common reactant source assembly for providing a first reactant to be combusted;

a plurality of burner elements for admitting the first reactant to each burner from the common reactant source assembly and combusting the first reactant with a second reactant, each of said plurality of burner elements further comprising:

an adjustable flow control, formed integrally with the respective burner element, for controlling the flow of the first reactant into the burner;

a blower assembly, formed integrally with the respective burner element, for generating a variable flow of the second reactant into the burner element; and a control system for measuring reactant flows and directing the operation of the blower assembly so that the variable rate of flow of the second reactant is generated in response to the rate of flow of the first reactant so as to maintain a desired fuel-to-air ratio.

9. The multiple burner assembly of claim 8 wherein the control system further comprises a first reactant pressure differential transducer and a second reactant pressure differential transducer for respectively measuring the flows of the first and second reactants, wherein the control system directs the blower assembly to generate a variable rate of flow in response to signals received from the respective transducers.

10. The multiple burner system of claim 9 wherein the first reactant is fuel and the second reactant is air and wherein:

the first reactant transducer measures a pressure differential across a metering device, and generates a first signal representative the fuel flow into the burner, said first signal is received by said control system;

a second reactant transducer which measures the air pressure differential between the burner and atmospheric, and generates a second signal representative of the air flow through the burner, said second signal is received by said control system;

and wherein the control unit compares the respective first and second signals in order to vary the air flow rate in response to the fuel flow rate so as to achieve a predetermined fuel-to-air ratio.

11. The multiple burner system of claim 8 wherein each respective flow control includes a control motor which opens and closes a valve in response to signals received from the control system and wherein the blower assembly includes an impeller attached to a variable speed motor which rotates the impeller to produce the variable rate of second reactant flow in response to signals received from the control system.

12. The multiple burner system of claim 8 wherein each of said plurality of burner elements is controlled by its own respective control system.

13. The multiple burner system of claim 8 wherein each of said plurality of burner elements is controlled by a common control system.

14. The multiple burner system of claim 8 wherein said first reactant is gas fuel and the second reactant is air.

* * * * *